US007090538B1

(12) United States Patent
Huang

(10) Patent No.: US 7,090,538 B1
(45) Date of Patent: Aug. 15, 2006

(54) ELECTRICAL ADAPTER INCLUDING FIRST AND SECOND HOUSING PARTS THAT DEFINE A RECESS THEREBETWEEN

(76) Inventor: George Y. Huang, 9 Studebaker, Irvine, CA (US) 92618

( * ) Notice: Subject to any disclaimer, the term of this patent is extended or adjusted under 35 U.S.C. 154(b) by 0 days.

(21) Appl. No.: 11/126,059

(22) Filed: May 9, 2005

(51) Int. Cl.
*H01R 25/00* (2006.01)
*H01R 27/02* (2006.01)

(52) U.S. Cl. ..... 439/638

(58) Field of Classification Search ..... 439/638, 439/628, 362, 654; D13/147
See application file for complete search history.

(56) References Cited

U.S. PATENT DOCUMENTS

D331,395 S * 12/1992 Lou ..... D14/357
D333,460 S * 2/1993 Huang ..... D13/147
D336,467 S * 6/1993 Pooley et al. ..... D14/433
5,779,499 A * 7/1998 Sette et al. ..... 439/540.1
D398,583 S * 9/1998 Sette et al. ..... D13/147
6,296,534 B1 * 10/2001 Yi ..... 439/876
6,612,875 B1 * 9/2003 Liao ..... 439/675
6,799,981 B1 * 10/2004 Yu ..... 439/133
D503,681 S * 4/2005 Huang ..... D13/147

* cited by examiner

*Primary Examiner*—Hae Moon Hyeon
(74) *Attorney, Agent, or Firm*—Darby & Darby

(57) ABSTRACT

An electrical adapter includes a housing, and first and second connectors. The housing includes a first housing part, and a second housing part that is transverse to the first housing part, that extends from the first housing part, and that has a size different from that of the first housing part. The first housing part and the second housing part cooperatively define a recess therebetween. The first connector is mounted on the first housing part. The second connector is mounted on the second housing part, is coupled to the first connector, and has a midpoint that lies in different horizontal plane from that of the first connector.

4 Claims, 5 Drawing Sheets

ELECTRICAL ADAPTER INCLUDING FIRST AND SECOND HOUSING PARTS THAT DEFINE A RECESS THEREBETWEEN

BACKGROUND OF THE INVENTION

1. Field of the Invention

The invention relates to an electrical adapter, more particularly to an electrical adapter that includes first and second housing parts that cooperate to define a recess therebetween.

2. Description of the Related Art

FIG. 1 illustrates a conventional electrical adapter 1 that includes a housing 11, and first and second connectors 12, 13. The housing 11 has opposite first and second end portions 111, 112. The first end portion 111 of the housing 11 defines an opening that faces away from the second end portion 112 of the housing 11. The second end portion 112 of the housing 11 defines an opening that faces away from the first end portion 111 of the housing 11. The first connector 12 is mounted in the first end portion 111 of the housing 11, and projects outwardly of the opening in the first end portion 111 of the housing 11. The second connector 13 is mounted in the second end portion 112 of the housing 11, has a different connector specification from that of the first connector 12, and projects outwardly of the opening in the second end portion 112 of the housing 11.

Referring to FIG. 2, the aforesaid conventional electrical adapter 1 is disadvantageous in that, since ports 21 are arranged in close proximity in most audio and video devices 2, when the conventional electrical adapter 1 is connected to one of the ports 21, the housing 11 of the conventional electrical adapter 1 may obstruct access to the other ports 21.

SUMMARY OF THE INVENTION

Therefore, the object of the present invention is to provide an electrical adapter that is capable of overcoming the aforesaid drawback of the prior art.

According to the present invention, an electrical adapter comprises a housing, and first and second connectors. The housing includes a first housing part that has first and second end portions, and a second housing part that is transverse to the first housing part, that extends from the first end portion of the first housing part, and that has a size different from that of the first housing part. The second end portion of the first housing part and the second housing part cooperatively define a recess therebetween. The first connector is mounted on the first housing part. The second connector is mounted on the second housing part, is coupled to the first connector, and has a midpoint that lies in different horizontal plane from that of the first connector.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
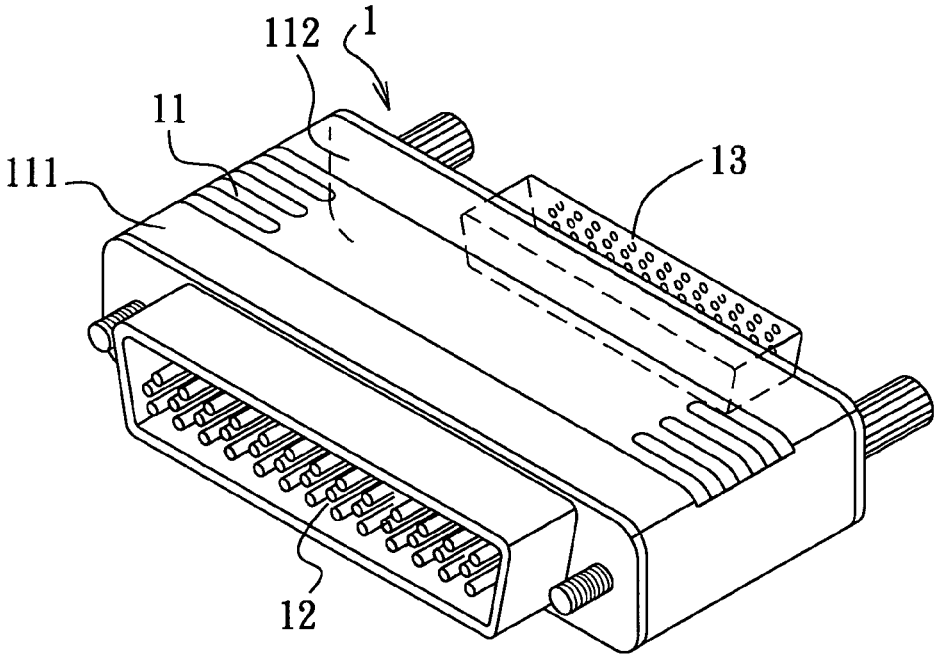
F I G. 1 PRIOR ART
FIG. 1 is a perspective view of a conventional electrical adapter.
Figure 2:
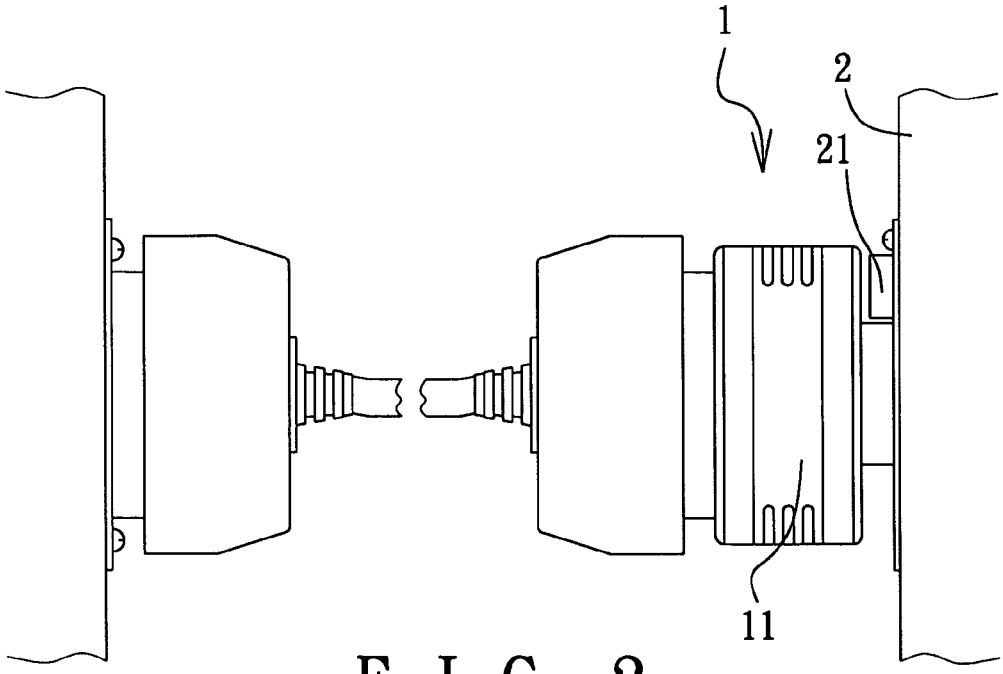
F I G. 2 PRIOR ART
FIG. 2 is a schematic view of the conventional electrical adapter in a state of use.

Before the present invention is described in greater detail, it should be noted that like elements are denoted by the same reference numerals throughout the disclosure.

Figure 3:
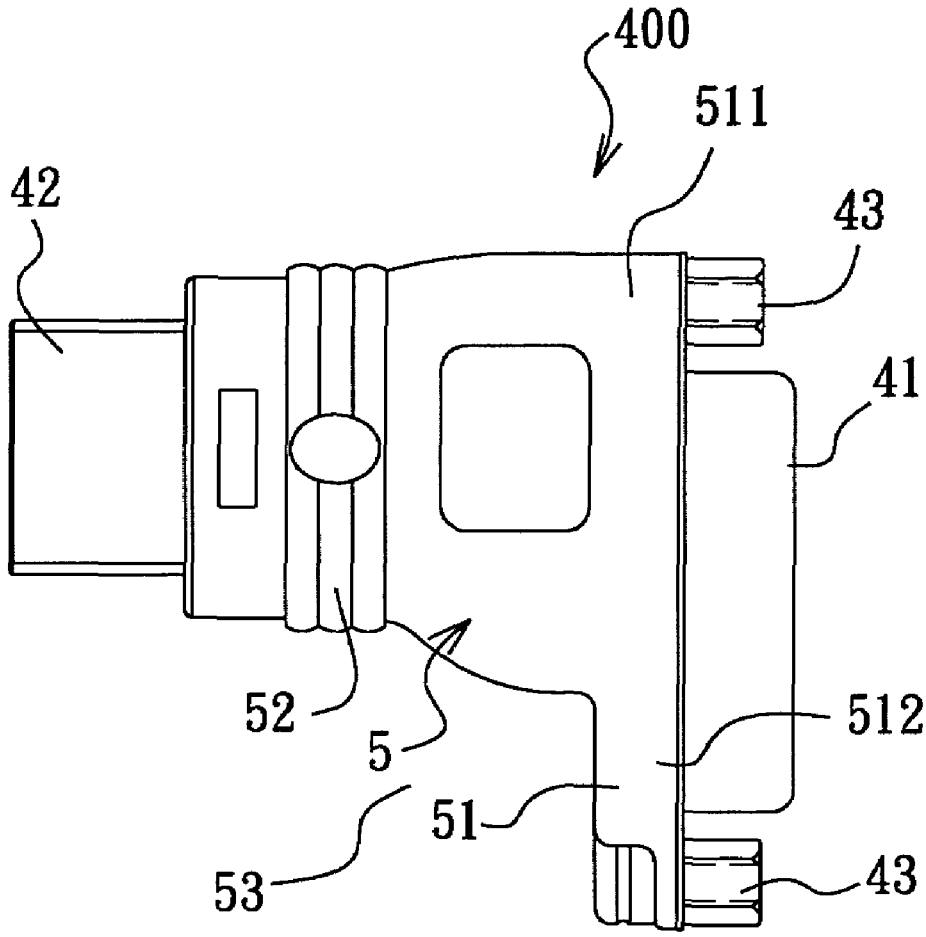
FIG. 3 is a schematic view of the preferred embodiment of an electrical adapter according to the present invention.
Figure 4:
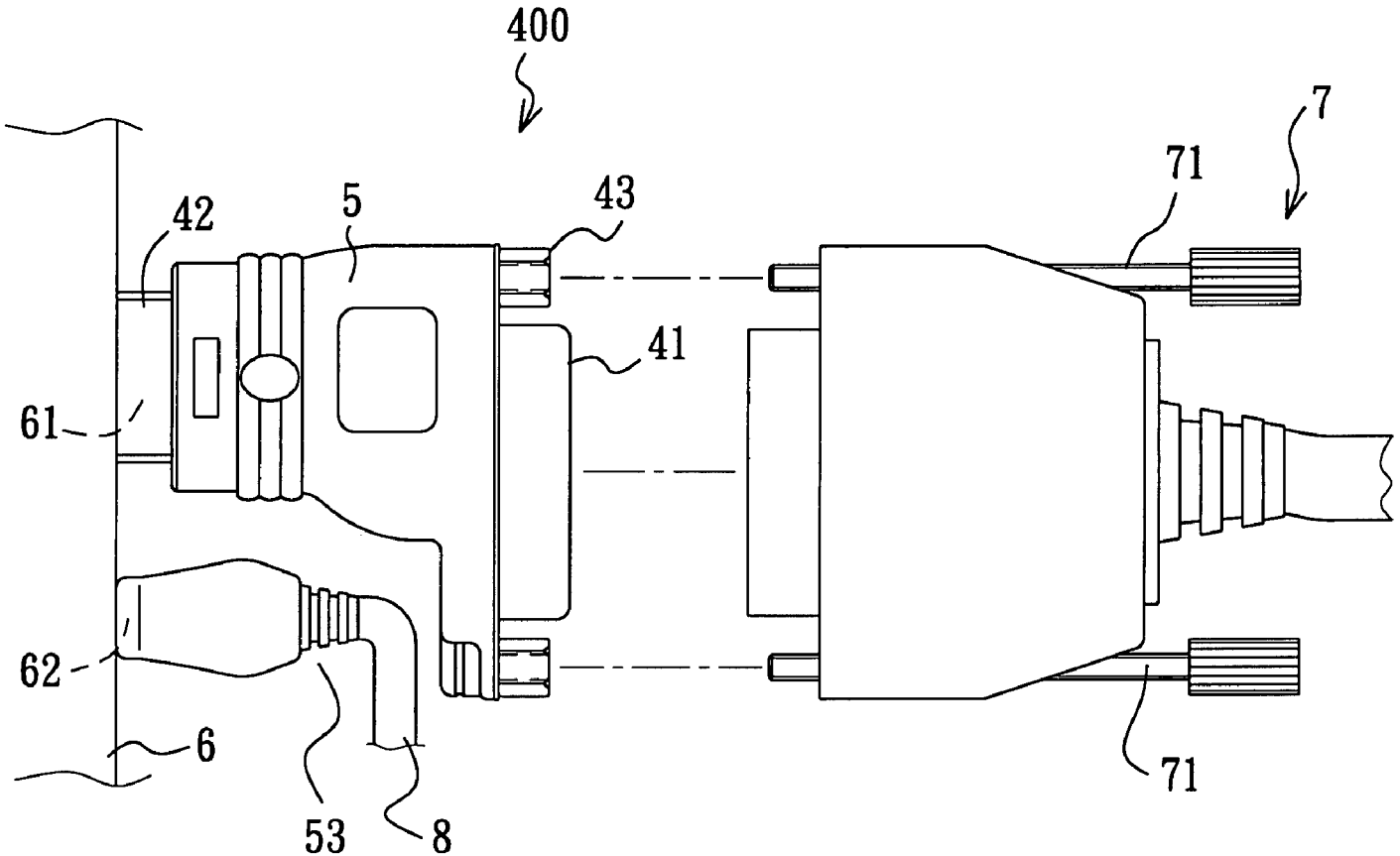
FIGS. 4 and 5 are schematic views of the preferred embodiment in a state of use.

Referring to FIGS. 3 and 4, the preferred embodiment of an electrical adapter 400 according to this invention is shown to include a housing 5, and first and second connectors 41, 42.

In this embodiment, the electrical adapter 400 is used to connect a high definition multimedia interface (HDMI) port 61 of a video transmitting device 6 to a digital video interface (DVI) port (not shown) of a display device (not shown) via a cable 7, in a manner that will be described hereinafter.

The video transmitting device 6 further has an input port 62 that is used to connect the video transmitting device 6 to an electronic device (not shown), such as an audio device, via a cable 8. It is noted that the HDMI port 61 and the input port 62 of the video transmitting device 6 are arranged in close proximity.

In this embodiment, the housing 5 is generally L-shaped. In particular, the housing 5 includes first and second housing parts 51, 52. The first housing part 51 has first and second endportions 511, 512. The second housing part 52 is transverse to the first housing part 51, extends from the first end portion 511 of the first housing part 51, and has a size different from that of the first housing part 51. The second end portion 512 of the first housing part 51 and the second housing part 52 cooperatively define a first recess 53 therebetween. The first housing part 51 has an opening that faces away from the second housing part 52. The second housing part 52 has an opening that faces away from the first housing part 51. It is noted that the opening in the first housing part 51 is formed in the first and second end portions 511, 522 of the first housing part 51.

The first connector 41 is mounted on the first housing part 51 and projects outwardly through the opening in the first housing part 51. In this embodiment, the first connector 41 complies with a DVI connector specification.

The electrical adapter 400 further includes a pair of retainers 43, each of which is disposed adjacent to a respective one of opposite ends of the first connector 51. The cable 7 is provided with a pair of screw fasteners 71, each of which engages threadedly a respective one of the retainers 43 so as to secure the cable 7 to the first connector 41. In an alternative embodiment, the retainers 43 may be dispensed with.

The second connector 42 is mounted on the second housing part 52, is coupled to the first connector 41, and projects outwardly through the opening in the second housing part 52. In this embodiment, the second connector 42 complies with a HDMI connector specification.

Figure 5:
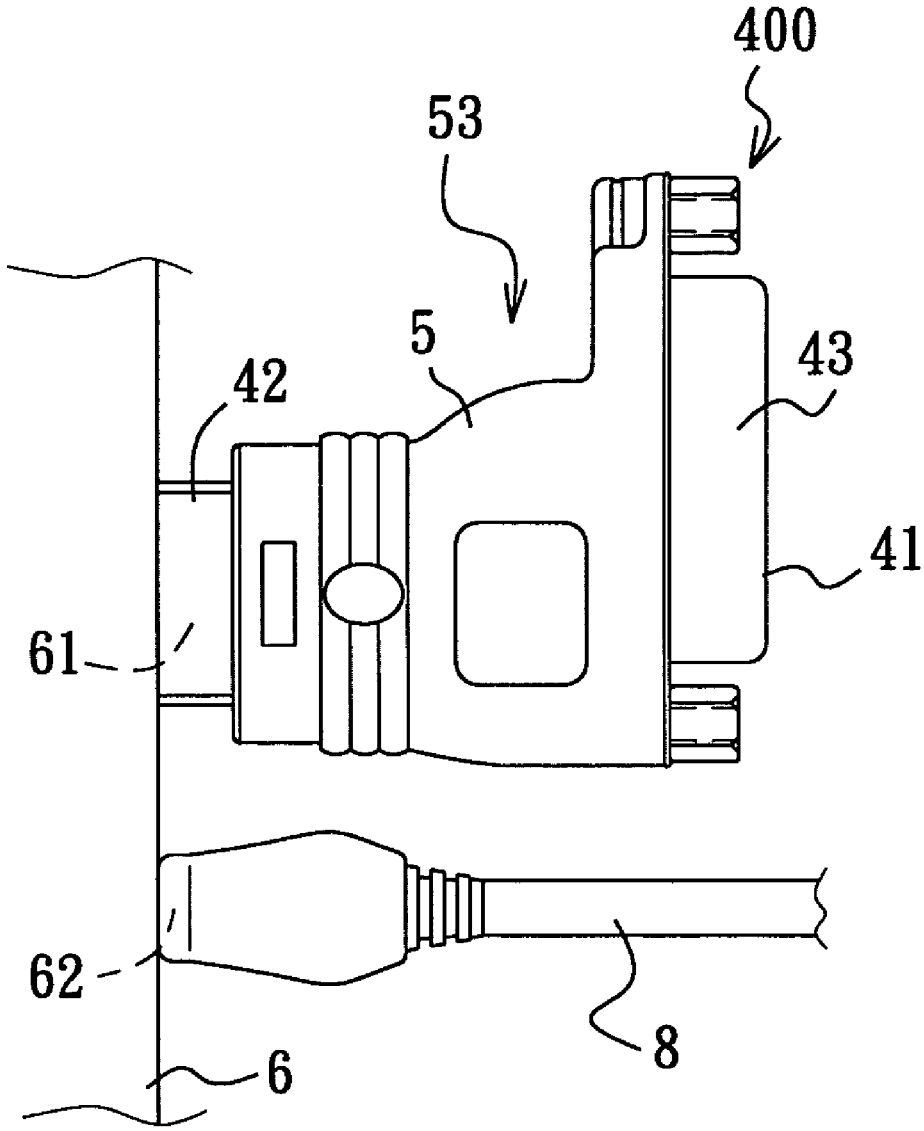

As illustrated in FIG. 4, depending on orientation of the HDMI port 61 of the video transmitting device 6, the electrical adapter 400 may be connected to the HDMI port 6 such that the cable 8 is disposed in the first recess 53, or, as illustrated in FIG. 5, the electrical adapter 400 may be connected to the HDMI port 6 of the video transmitting device 6 such that the cable 8 is totally avoided.

It is noted that, in this embodiment, the second connector 42 has a length that is shorter than that of the first connector 41. In an alternative embodiment, the first and second connectors 41, 42 have the same length.

It is also noted that, in this embodiment, the first and second connectors 41, 42 extend vertically, and have midpoints that lie in different horizontal planes.

It is further noted that, in this embodiment, the first connector 41 is a female connector, whereas the second connector 42 is a male connector. In an alternative embodiment, the first connector 41 is a male electrical connector, whereas the second connector 42 is a female connector. In yet another alternative embodiment, both the first and second connectors 41, 42 may be male or female connectors.

Figure 6:
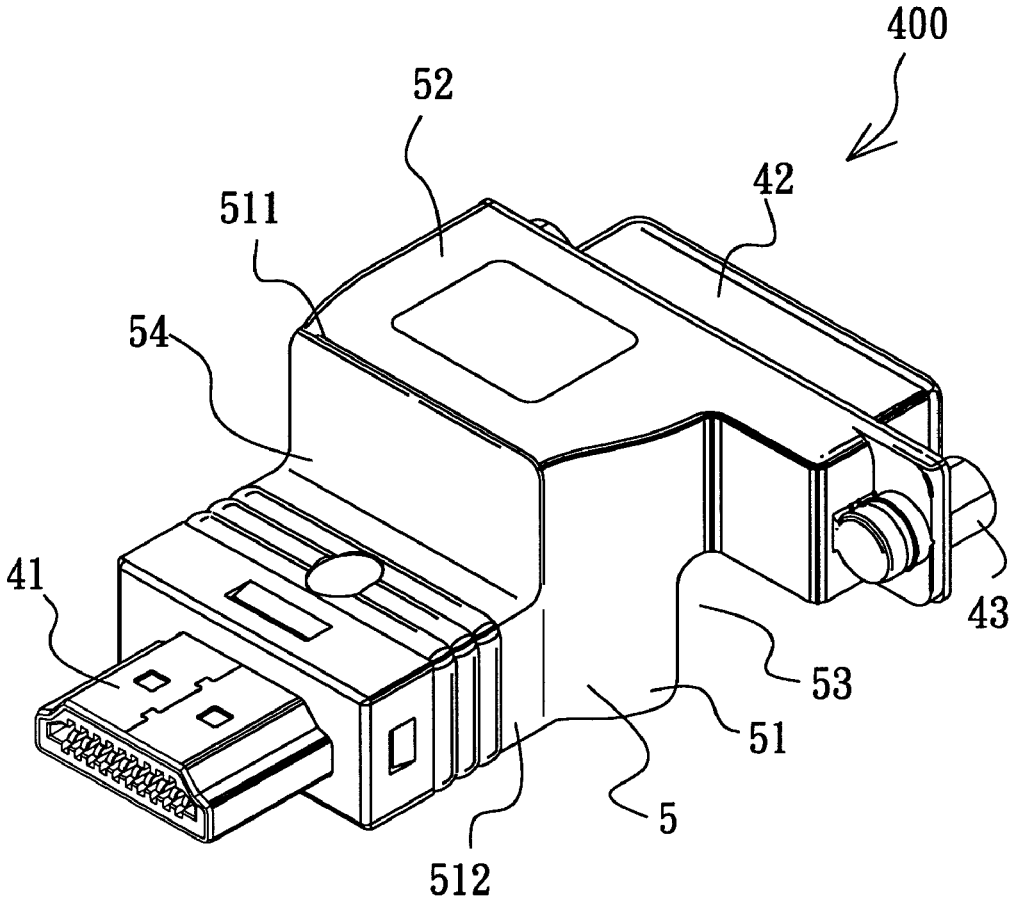
FIG. 6 is a perspective view of an alternative embodiment of an electrical adapter according to this invention.

In an alternative embodiment, as illustrated in FIG. 6, the housing 5 is generally Z-shaped. In particular, the first and second end portions 511, 512 of the first housing part 51 are transverse to each other and cooperatively define a second recess 54 therebetween. Moreover, the opening in the first housing part 51 is formed in the second end portion 512 of the first housing part 51. Further, each of the first and second connectors 41, 42 extends horizontally.

From the above description, when the second connector 42 is connected to the HDMI port 61 of the video transmitting device 6, the first recess 53 between the second end portion 512 of the first housing part 51 and the second housing part 52 serves as a clearance between the input port 62 of the video transmitting device 6 and the second end portion 512 of the first housing part 51, as best shown in FIG. 4. As such, the electrical adapter 400 of this invention does not obstruct access to the input port 62 of the video transmitting device 6.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An electrical adapter, comprising:

a housing having a generally Z-shape, and including a first housing part, and a second housing part that is parallel to said first housing part, and defining first and second recesses a first connector mounted on said first housing part; and a second connector mounted on said second housing part and coupled electrically to said first connector.

2. The electrical adapter as claimed in claim 1, wherein said first housing part defines an opening that faces away from said second housing part, said second housing part defining an opening that faces away from said first housing part, said first connector projecting outwardly through said opening in said first housing part, said second connector projecting outwardly through said opening in said second housing part.

3. The electrical adapter as claimed in claim 1, wherein said first connector complies with a digital video interface (DVI) connector specification.

4. The electrical adapter as claimed in claim 1, wherein said second connector complies with a high definition multimedia interface (HDMI) connector specification.

* * * * *